US009244376B2

(12) United States Patent
Kuramoto et al.

(10) Patent No.: US 9,244,376 B2
(45) Date of Patent: Jan. 26, 2016

(54) DEVELOPING DEVICE

(71) Applicant: FUJI XEROX CO., LTD, Minato-ku, Tokyo (JP)

(72) Inventors: Shinichi Kuramoto, Kanagawa (JP); Yasutomo Ishii, Kanagawa (JP); Ryota Tomishi, Kanagawa (JP); Shinji Okuyama, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/280,768

(22) Filed: May 19, 2014

(65) Prior Publication Data

US 2015/0093139 A1 Apr. 2, 2015

(30) Foreign Application Priority Data

Oct. 2, 2013 (JP) ..... 2013-207238

(51) Int. Cl.
*G03G 15/08* (2006.01)
*G03G 15/09* (2006.01)

(52) U.S. Cl.
CPC ..... *G03G 15/0806* (2013.01); *G03G 15/0921* (2013.01)

(58) Field of Classification Search
CPC ..... G03G 15/0896; G03G 21/206; G03G 2221/1645; G03G 15/09
See application file for complete search history.

(56) References Cited

U.S. PATENT DOCUMENTS

| | | | | |
|---|---|---|---|---|
| 4,800,411 | A * | 1/1989 | Tanaka et al. | 399/103 |
| 7,103,298 | B2 * | 9/2006 | Satoh | 399/98 |
| 7,991,318 | B2 * | 8/2011 | Tamura et al. | 399/92 |
| 2013/0108310 | A1 * | 5/2013 | Hirakawa et al. | 399/92 |

FOREIGN PATENT DOCUMENTS

| | | | |
|---|---|---|---|
| JP | 63159887 | A * | 7/1988 |
| JP | 2005-346035 | A | 12/2005 |
| JP | 2006-250973 | A | 9/2006 |
| JP | 2008-39965 | A | 2/2008 |
| JP | 4695542 | B2 | 6/2011 |

* cited by examiner

*Primary Examiner* — Gregory H Curran
(74) *Attorney, Agent, or Firm* — Sughrue Mion, PLLC

(57) ABSTRACT

Provided is a developing device including a storage container that stores a developer, a rotating body that supplies the developer to an image holding member in a supply region by being rotated with holding the developer, an inflow portion that is provided with an inflow port placed on a downstream side of the supply region in a rotation direction of the rotating body, and flows air into the storage container, and an outflow portion that is provided with an outflow port and emits air in the storage container from the outflow port, wherein the outflow port and the inflow port are placed to be adjacent to each other.

20 Claims, 4 Drawing Sheets

DEVELOPING DEVICE

CROSS-REFERENCE TO RELATED APPLICATIONS

This application is based on and claims priority under 35 USC 119 from Japanese Patent Application No. 2013-207238 filed Oct. 2, 2013.

BACKGROUND

Technical Field

The present invention relates to a developing device.

SUMMARY

According to an aspect of the invention, there is provided a developing device including:

a storage container that stores a developer;

a rotating body that supplies the developer to an image holding member in a supply region by being rotated with holding the developer;

an inflow portion that is provided with an inflow port placed on a downstream side of the supply region in a rotation direction of the rotating body, and flows air into the storage container; and an outflow portion that is provided with an outflow port and emits air in the storage container from the outflow port, wherein the outflow port and the inflow port are placed to be adjacent to each other.

BRIEF DESCRIPTION OF THE DRAWINGS

Exemplary embodiments of the present invention will be described in detail based on the following figures, wherein.

DETAILED DESCRIPTION

Next, an exemplary embodiment of the present invention will be described with reference to the drawings.

Figure 1:
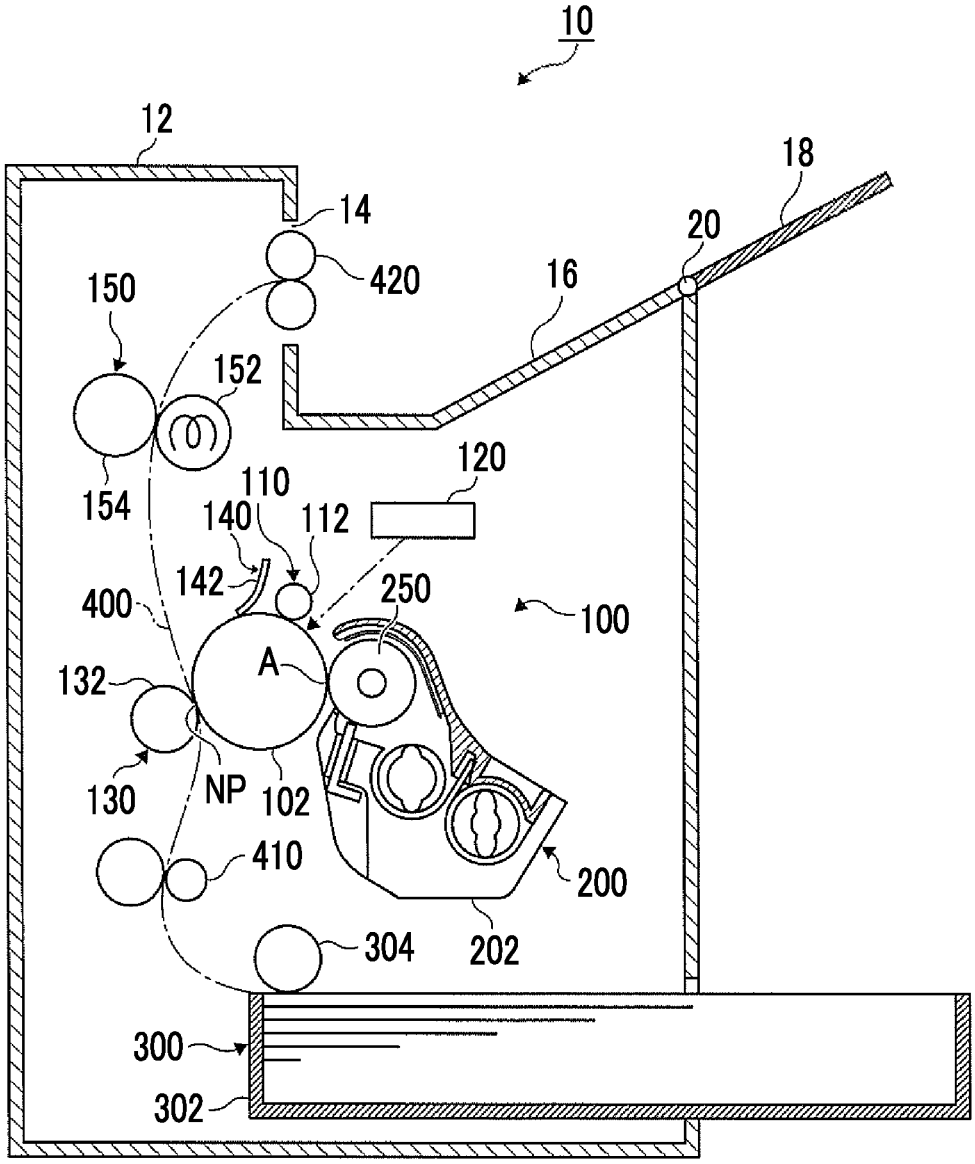
FIG. 1 is a view illustrating an image forming apparatus according to an exemplary embodiment of the present invention.

FIG. 1 illustrates an image forming apparatus 10 according to the exemplary embodiment of the present invention. As illustrated in FIG. 1, the image forming apparatus 10 includes an image forming apparatus body 12, and an image forming portion 100 and a sheet feeding device 300 are provided in the image forming apparatus body 12. In addition, a transport path 400 for transporting a sheet used as a recording medium is formed in the image forming apparatus body 12.

A sheet discharging port 14 for discharging the sheet is formed in the image forming apparatus body 12. Moreover, an upper surface of the image forming apparatus body 12 is used as a discharging portion 16. The sheet is discharged from the inner portion of the image forming apparatus body 12 to the discharging portion 16 via the sheet discharging port 14. In addition, a support plate 18 is attached to the image forming apparatus body 12.

The support plate 18 is a member for supporting the sheet discharged from the inner portion of the image forming apparatus body 12 along with the discharging portion 16, and is attached to the image forming apparatus body 12 so that the support plate moves to be rotated about a hinge 20.

For example, the image forming portion 100 forms a monochromatic image, and adopts an electrophotographic system. Moreover, the image forming portion 100 includes: a photoconductor 102 that is used as an image holding member holding an image; a charging device 110 that charges the photoconductor 102; a latent image forming device 120 that radiates light to a surface of the photoconductor 102 charged by the charging device 110 and forms an electrostatic latent image on the surface of the photoconductor 102; a developing device 200 that develops the latent image formed on the photoconductor 102 using a developer including toner and forms a toner image on the surface of the photoconductor 102; a transfer device 130 that transfers the toner image formed on the surface of the photoconductor 102 by the developing device 200 to the sheet; a cleaning device 140 that cleans the photoconductor 102 after the toner image is transferred to the sheet by the transfer device 130; and a fixing device 150 that fixes the toner image transferred to the sheet by the transfer device 130 to the sheet.

The charging device 110 includes a charging member 112. For example, the charging member 112 has a roll shape and is placed to come into contact with the photoconductor 102 or is placed to be close to the photoconductor 102. In addition, a direct current charged voltage or a charged voltage, in which an indirect current overlaps with a direct current, is applied to the photoconductor from a power source (not illustrated), and thus, the photoconductor 102 is charged.

The developing device 200 is a so-called two-component developing device that develops the latent image using a developer in which toner and a carrier are mixed with each other, and for example, a developer is used in which nonmagnetic toner charged to a negative polarity, a magnetic carrier charged to a positive polarity, or the like are mixed with one another. Moreover, the developing device 200 includes a developing device body 202 that is used as a developer storage container in which the developer is stored, and a toner movement mechanism 250 that is a mechanism for moving the toner in the developer stored in the developing device body 202 to the photoconductor 102. The details of the developing device 200 will be described below.

The transfer device 130 includes a transfer member 132. For example, the transfer member 132 has a roll shape, and is placed to come into contact with the photoconductor 102. In addition, a voltage for the transfer is applied to the transfer portion from a power source (not illustrated).

The cleaning device 140 includes a cleaning member 142. For example, the cleaning member 142 has a plate-shaped member, one end portion of the cleaning member is pressed to the photoconductor 102, the developer or the like is removed from the surface of the photoconductor 102 by the pressed end portion, and thus, the photoconductor 102 is cleaned.

The fixing device 150 includes a heating roll 152 that has a heat source in the inner portion, and a pressure roll 154 that comes into contact with the heating roll 152, the toner transferred to the sheet is heated and pressed at a contact portion between the heating roll 152 and the pressure roll 154, and thus, the toner image is fixed to the sheet.

The sheet feeding device 300 supplies the sheet toward the image forming portion 100. Moreover, the sheet feeding device 300 includes a sheet storage container 302 in which the sheets are stored in a state of being overlapped, and a feeding roll 304 that feeds the sheet from the sheet storage container 302.

In the transport path 400, the sheet is transported from the feeding device 300 toward the transfer device 130, transported from the transfer device 130 toward the fixing device 150, and transported to be discharged from the inner portion of the image forming apparatus body 12. In the vicinity of the transport path 400, the above-described feeding roll 304, a registration roll 410, the above-described transfer device 130, the above-described photoconductor 102, the above-described fixing device 150, and a discharging roll 420 are placed in this order from an upstream side in the transport direction of the sheet along the transport path 400.

The registration roll 410 temporarily stops a movement of a tip portion of the sheet transported toward a contact position NP at which the photoconductor 102 and the transfer member 132 contact with each other, and restarts the movement of the photoconductor 102 toward the contact position NP of the tip portion of the sheet so that the movement of the photoconductor 102 coincides with a timing at which an image is formed by the toner.

The discharging roll 420 discharges the sheet, on which the toner image is fixed by the fixing device 150, outside the image forming apparatus body 12.

A illustrated in FIG. 1 indicates a supply region at which the developer is supplied from a developing sleeve 260, described below, to the photoconductor 102 (refer to FIG. 2).

Figure 2:
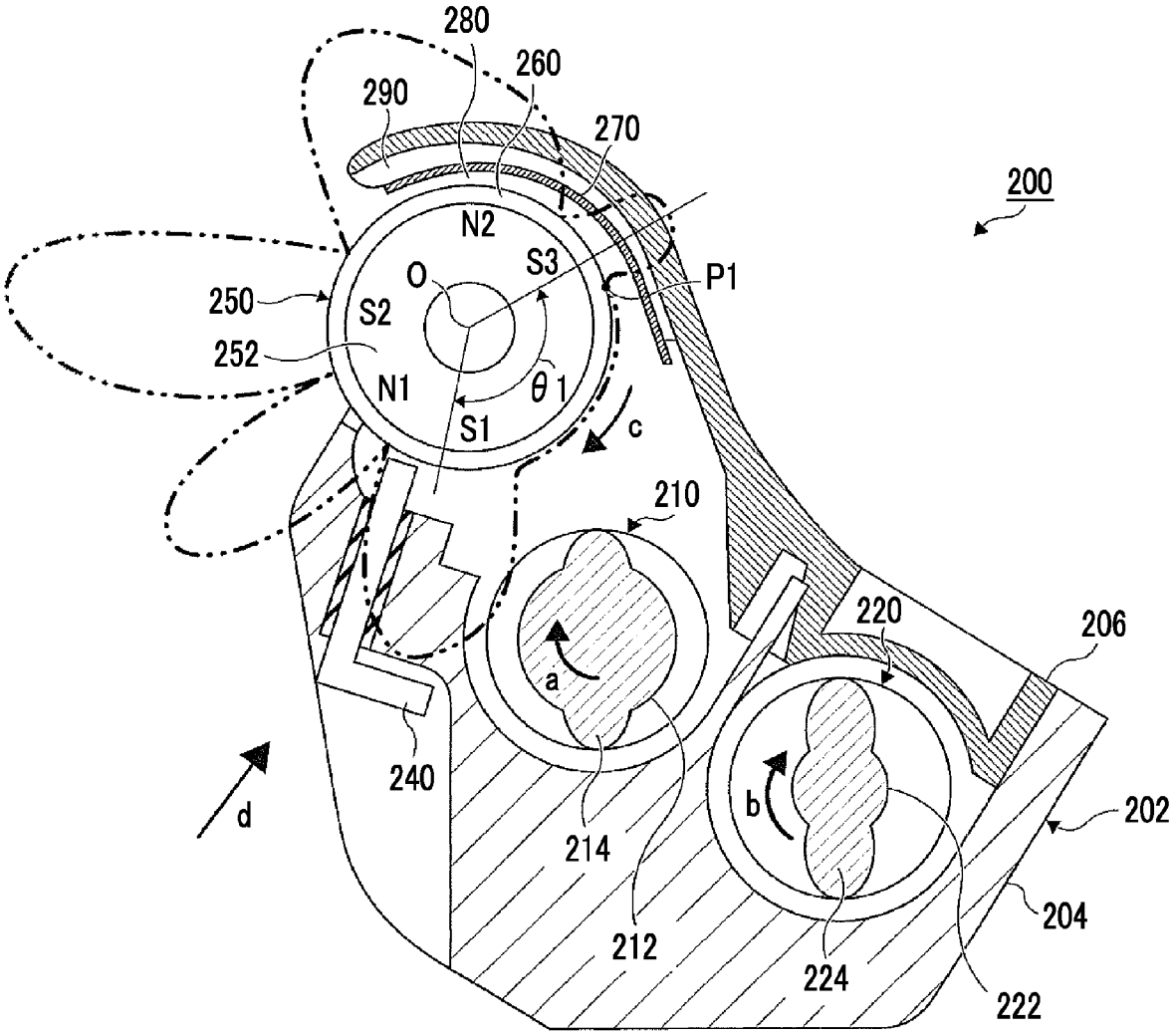
FIG. 2 is a view illustrating a developing device that is included in the image forming apparatus illustrated in FIG. 1.

FIG. 2 illustrates the developing device 200. As described above, the developing device 200 includes the developing device body 202 and the toner movement mechanism 250. As illustrated in FIG. 2, the toner movement mechanism 250 includes a magnetic member 252 that includes plural magnetic poles, and the developing sleeve 260. Details of the magnetic member 252 and the developing sleeve 260 will be described below.

The developing device body 202 includes a lower body portion 204 that is positioned at the lower portion of the body 202, and a cover member 206 that is mounted on the lower body portion 204 to cover an opening portion formed on the upper portion of the lower body portion 204. For example, in the cover member 206 of the developing device body 202, a replenishing opening portion (not illustrated), through which an inner side of the developing device body 202 and an outer side of the developing device body 202 communicates with each other, is formed, and the toner is replenished from the toner accommodating container (not illustrated) to the inner portion of the developing device body 202 via the replenishing opening portion.

Moreover, the developing device 200 includes a thickness regulating member 240 that regulates a thickness of the developer attracted on the surface of the developing sleeve 260. The thickness regulating member 240 is mounted on the developing device body 202 so that a predetermined gap is formed between the end portion of the developing sleeve 260 side and the developing sleeve 260.

In addition, the developing device 200 includes an agitating and carrying member 210 that agitates the developer accommodated in the developing device body 202 and carries the developer to the toner movement mechanism 250. The agitating and carrying member 210 includes a shaft portion 212 and a blade portion 214 that is spirally formed on an outer circumferential surface of the shaft portion 212, the shaft portion 212 and the blade portion 214 are integrally rotated in an arrow a direction illustrated in FIG. 2, the blade portion 214 presses the developer, and thus, the developer in the developing device body 202 is agitated and carried. The agitating and carrying member 210 carries the developer in a longitudinal direction (a direction perpendicular to a page face in FIG. 2) of the agitating and carrying member 210, and carries the developer to move the developer toward the direction of the toner movement mechanism 250 (to move the developer from a right side to a left side in FIG. 2).

Moreover, the developing device 200 includes an agitating and carrying member 220. The agitating and carrying member 220 includes a shaft portion 222 and a blade portion 224 that is spirally formed on an outer circumferential surface of the shaft portion 222, the shaft portion 222 and the blade portion 224 are integrally rotated in an arrow b direction illustrated in FIG. 2, the blade portion 224 presses the developer, and thus, the developer in the developing device body 202 is agitated and carried. More specifically, the agitating and carrying member 220 carries the developer in a longitudinal direction of the agitating and carrying member 220. By the agitating and carrying member 220 and the above-described agitating and carrying member 210, the developer in the developing device body 202 is agitated and carried, and thus, the toner in the developer rubs the carrier or the like, and thus, the toner is charged by friction between the toner and the carrier or the like.

The developing sleeve 260 rotates in a state where the sleeve holds the developer, and thus, is used as a rotating body that supplies the developer to the photoconductor 102. In addition, since the developing sleeve 260 rotates in the state where the sleeve holds the developer, the developing sleeve is used as a rotating body that particularly supplies the toner in the developer to the photoconductor 102 (refer to FIG. 1) in a supply region A (refer to FIG. 1). In addition, the developing sleeve 260 is formed of a nonmagnetic body, and for example, has a cylindrical shape. Moreover, a motor or the like (not illustrated) used as a driving source is connected to the developing sleeve 260 via a driving transmission mechanics (not illustrated) that is configured of a gear train or the like, for example. The driving of the motor or the like is transmitted via the driving transmission mechanics, and thus, the developing sleeve rotates in an arrow c direction illustrated in FIG. 2.

For example, the magnetic member 252 has a columnar shape, and includes plural magnetic poles extending in the longitudinal direction of the magnetic member 252. Specifically, for example, the magnetic member 252 includes five magnetic poles, and more specifically, includes five magnetic poles such as an attraction magnetic pole S1, a carrying magnetic pole N1, a developing magnetic pole S2, a carrying magnetic pole N2, and a separation magnetic pole S3.

The attraction magnetic pole S1 is used to attract the developer, which is carried to the developing sleeve 260 side by the agitating and carrying member 210, to the surface of the developing sleeve 260. Here, the above-described thickness regulating member 240 is placed so that the end portion of the developing sleeve 260 side is positioned within a range where a magnetic force of the attraction magnetic pole S1 acts. Accordingly, the developer, which does not pass through the gap between the developing sleeve 260 and the thickness regulating member 240 in the developer that is attracted to the developing sleeve 260 by the magnetic force of the attraction magnetic pole S1, is separated from the surface of the developing sleeve 260 by the thickness regulating member 240, and thus, the thickness of the developer attracted to the developing sleeve 260 is regulated.

The carrying magnetic pole N1 is placed on a downstream side of the attraction magnetic pole S1 in the rotation direction of the developing sleeve 260, maintains adsorption of the developer with respect to the surface of the developing sleeve 260, and thus, is used to carry the developer according to the rotation of the developing sleeve 260. Moreover, the developing magnetic pole S2 is placed on a downstream side of the carrying magnetic pole N1 in the rotation direction of the developing sleeve 260, and is used to develop an electrostatic latent image, which is formed on the surface of the photoconductor 102 placed in the vicinity of a movement region in which the toner moves from the surface of the developing sleeve 260 to the photoconductor 102 (refer to FIG. 1), using the toner.

The carrying magnetic pole N2 is placed on a downstream side of the developing magnetic pole S2 in the rotation direction of the developing sleeve 260, and similar to the above-described carrying magnetic pole N1, maintains adsorption of the developer with respect to the surface of the developing sleeve 260, and thus, is used to carry the developer according to the rotation of the developing sleeve 260. Moreover, the separation magnetic pole S3 is placed on a downstream side of the carrying magnetic pole N2 in the rotation direction of the developing sleeve 260, and is used to separate the developer from the surface of the developing sleeve 260.

In addition, in the developing device 200, when a rotation center of the developing sleeve 260 is set to a rotation center O, an angle θ1 between the separation magnetic pole S3 and the attraction magnetic pole S1 that have the rotation center O as the centers is 135°.

Moreover, the developing device 200 includes a forming member 270 that forms an inflow portion 280 described below and an outflow portion 290 similarly described below. Details of the forming member 270 will be described below. P1 illustrated in FIG. 2 indicates a position at which the developer is separated from the surface of the developing sleeve 260. Hereinafter, the position, at which the developer is separated from the surface of the developing sleeve 260, is referred to a separation position P1.

Two-dot chain lines in FIG. 2 indicate positions in which components, which are in a direction perpendicular to the surface of the developing sleeve 260 of magnetic fields formed by the attraction magnetic pole S1, the carrying magnetic pole N1, the developing magnetic pole S2, the carrying magnetic pole N2, and the separation magnetic pole S3 included in the magnetic member 252, are 20 mT. Accordingly, the portion, in which the distance from the center of the magnetic member 252 to the two-dot chain line drawn to enclose each magnetic pole is longest, indicates a position at which the magnetic pole becomes the maximum.

Figure 3:
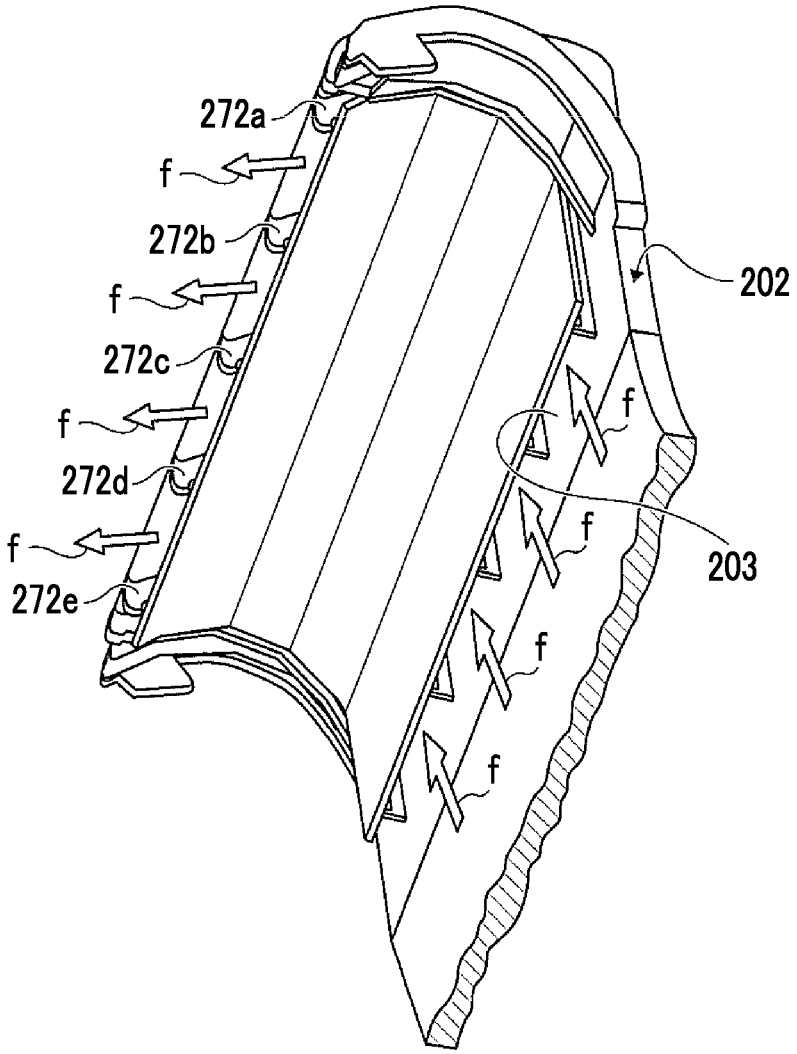
FIG. 3 is a view illustrating a state where a forming member is mounted on a body of the developing device illustrated in FIG. 2 when viewed from an arrow d direction illustrated in FIG. 2.

FIG. 3 illustrates a state where the forming member 270 is mounted on the developing device body 202 when viewed in an arrow d direction illustrated in FIG. 2. As illustrated in FIG. 3, for example, the forming member 270 is mounted on an inner wall 203 using five support members 272*a*, 272*b*, 272*c*, 272*d*, and 272*e* so that a space is formed between the forming member 270 and the inner wall 203 of the developing device body 202. Moreover, the space is used as the outflow portion 290 (refer to FIGS. 2 and 4). In addition, arrows f in FIG. 3 schematically show flows of air emitted from the inner portion of the developing device body 202 to the outer portion of the developing device body 202 to pass through the outflow portion 290 (also refer to FIG. 4).

Figure 4:
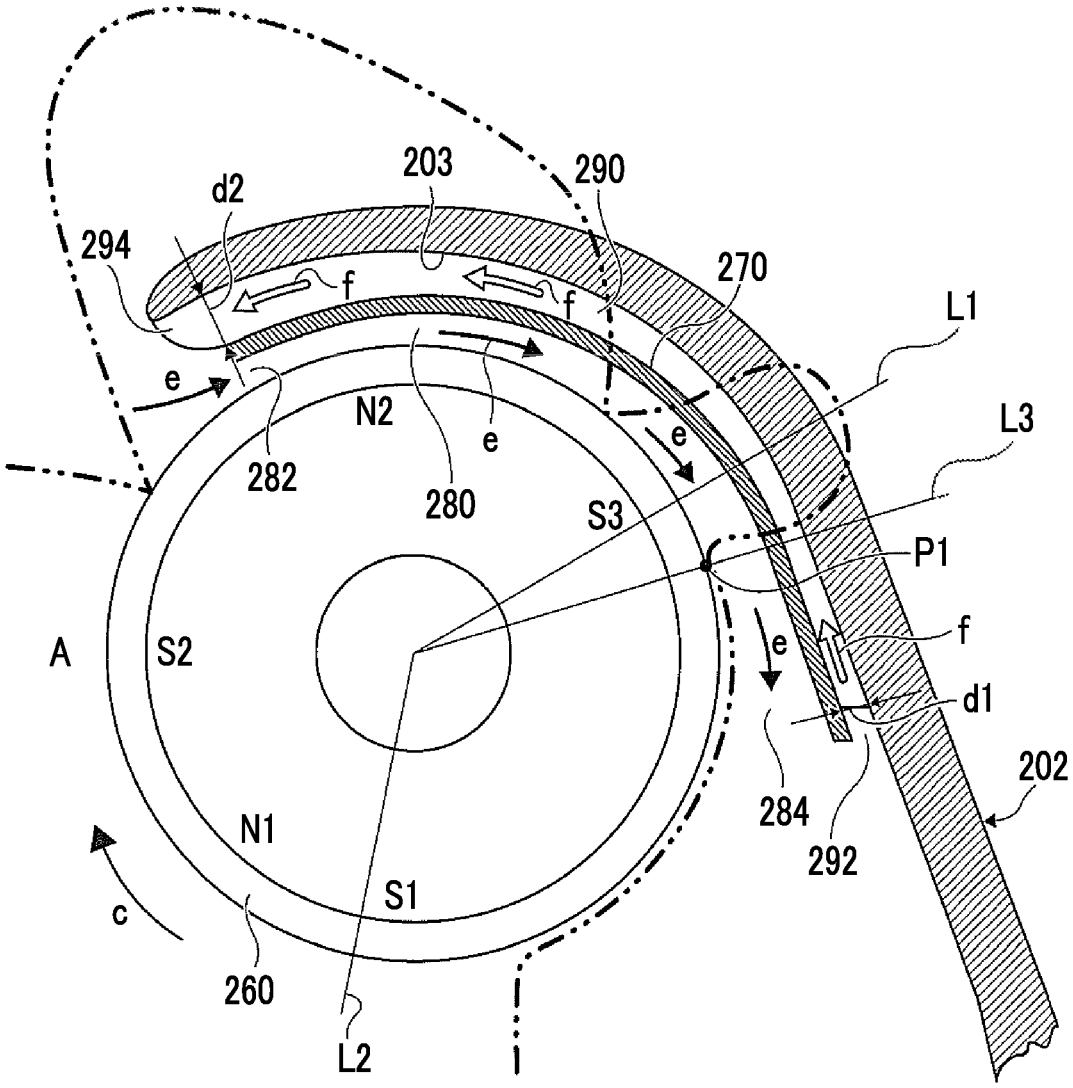
FIG. 4 is a view illustrating a position at which the forming member is mounted on the body of the developing device illustrated in FIG. 2.

FIG. 4 illustrates a position of the forming member 270 inside the developing device body 202. As illustrated in FIG. 4, the forming member 270 is placed between the inner wall 203 and the photoconductor 102. Moreover, a space between the photoconductor 102 and the outflow portion 290 is used as the inflow portion 280.

In the inflow portion 280, an inflow port 282, in which the air is flowed, is placed on a downstream side of the supply region A (also refer to FIG. 1), at which the toner in the developer is particularly supplied from the developing sleeve 260 to the photoconductor 102 (refer to FIG. 1), in the rotation direction of the developing sleeve 260 shown in the arrow c. In addition, in the inflow portion 280, an outlet port 284 for air is placed inside the developing device body 202. Moreover, the air is flowed in the inflow portion 280 from the inflow port 282 to be flowed in according to the rotation in the arrow c direction of the developing sleeve 260, and is flowed in the developing device body 202 so that the inflow air passes through the outlet port 284.

In this way, the air flows into the developing device body 202, and thus, atmospheric pressure in the developing device body 202 is increased. For example, the atmospheric pressure is further increased as the rotation of the developing sleeve 260 is increased according to the increase of an image forming speed of the image forming apparatus 10 or the like. Arrows e in FIG. 4 schematically show the flows of the air that flows from the outer portion of the developing device body 202 into the inner portion of the developing device body 202 to pass through the inflow portion 280.

The outflow portion 290 is used as a flow path which is provided to communicate a space inside the developing device body 202 with a space outside the developing device body 202. In this way, since the outflow portion 290 is provided, the space inside the developing device body 202 and the space outside the developing device body 202 continue to each other, and accordingly, for example, an increase of the atmospheric pressure in the developing device body 202 according to the rotation of the developing sleeve 260 or the like may be suppressed. Meanwhile, if the outflow portion 290 is provided, since the air is emitted while being gradually decompressed from the inner portion of the developing device body 202, the air passes through the outflow portion 290 from the inner portion of the developing device body 202 to the outer portion of the developing device body 202, and thus, there is a concern that the toner may be scattered.

In addition, in the outflow portion 290, the air in the developing device body 202 flows into an inlet port 292 placed in the developing device body 202, the air is emitted from an outflow port 294, and thus, the air in the developing device body 202 is emitted to the outer portion of the developing device body 202. The inlet port 292 is placed in the vicinity of the outlet port 284 of the inflow portion 280. More specifically, the inlet port 292 is adjacent to the outlet port 284 so that one end portion of the forming member 270 is interposed between the inlet port 292 and the outlet port 284.

The outflow port 294 is placed in the vicinity of the inflow port 282 of the inflow portion 280. More specifically, the outflow port 294 is placed to be adjacent to the inflow port 282 so that the other end portion of the forming member 270 is interposed between the outflow port 294 and the inflow port 282. In this way, since the outflow port 294 and the inflow port 282 are placed to be adjacent to each other, a size of the developing device body 202 is not increased, and thus, a length of the outflow portion 290 is secured. Moreover, since the length of the outflow portion 290 is secured, the atmospheric pressure in the vicinity of the outflow port 294 in the outflow portion 290 is lower than the atmospheric pressure in the vicinity of the inlet port 292 in the outflow portion 290. More specifically, a pressure gradient is formed in the outflow portion 290, and the atmospheric pressure in the outflow portion 290 is gradually decreased toward the outflow port 294.

In addition, the length or the like of the outflow portion 290 is determined so that the atmospheric pressure in the vicinity of the outflow port 294 of the outflow portion 290 is equal to the pressure of the outer portion of the outflow portion 290. Here, the atmospheric pressure in the vicinity of the outflow port 294 of the outflow portion 290 being equal to the pressure of the outer portion of the outflow portion 290 includes both pressures being the same as each other, and for example, permits a difference due to measurement errors, or the like. In this way, since the atmospheric pressure in the vicinity of the outflow port 294 in the outflow portion 290 is equal to the pressure of the outer portion of the outflow portion 290, there is no concern that the air in the outflow portion 290 is emitted by a strong force to be ejected from the outflow port 294 to the outer portion of the developing device body 202 due to the atmospheric pressure difference between the inner portion and the outer portion of the outflow portion 290. Accordingly, the need of a filter or the like in the portion of the outflow port is decreased.

Moreover, as illustrated in FIG. 4, a gap d2 between the forming member 270 and the inner wall 203 in the vicinity of the outflow port 294 is larger than a gap d1 between the forming member 270 and the inner wall in the vicinity of the inlet port 292. In addition, a width of the outflow portion 290 (a length in a direction crossing the page face in FIG. 4) is constant from the inlet port 292 to the outflow port 294. Accordingly, in the outflow portion 290, in a cross-sectional area in the direction crossing a direction that air flows through the outflow portion which is shown by the arrow f, the cross-sectional area in the outflow port 294 is larger than the cross-sectional area in the inlet port 292. Moreover specifically, in the outflow portion 290, the area in the direction crossing a direction that air flows through the outflow portion is gradually increased from the inlet port 292 side toward the outflow port 294 side. Accordingly, the pressure gradient is easily formed in the outflow portion 290 in which the pressure is decreased as much as the outflow port 294 side.

In addition, as illustrated in FIG. 4, the outflow port 294 is placed at a position further away from the photoconductor 102 than the inflow port 282, and is provided so that the inflow port 282 is positioned between the outflow port 294 and the photoconductor 102. Accordingly, the emission of the air from the outflow port 294 does not easily interfere with an air flow shown by the arrow e according to the rotation in the arrow c direction of the photoconductor 102, and the air flow shown by the arrow e does not easily obstruct the air emission from the outflow port 294.

In addition, in a downstream side of a line L1 connecting the rotation center O of the developing sleeve 260 and the separation magnetic pole S3 in the rotation direction (arrow c direction) of the developing sleeve 260, the inlet port 292 is placed at the position of an upstream side of a line L2 connecting the rotation center O and the attraction magnetic pole S1 in the rotation direction of the developing sleeve 260, and the air in the developing device body 202 flows from the placed inlet port 292 to the outflow portion 290. Here, in a speed of the air flowing in the developing device body 202, in the downstream side of the line L1 in the rotation direction of the developing sleeve 260, the speed at the position on the upstream side of the line L2 in the rotation direction of the developing sleeve 260 is lower than the speed of other positions. Accordingly, compared to when the inlet port 292 is placed at the other positions in the developing device body 202 and the air flows from the inlet port 292 into the outflow portion 290, the toner floating in the developing device body 202 does not easily reach the inlet port 292, and the toner does not easily enter into the inner portion of the outflow portion 290 through the inlet port 292.

Here, for example, as a cause of the toner floating in the developing device body 202, when the developing sleeve 260 rotates, when the developer is operated to be separated from the surface of the developing sleeve 260, the developer is operated to be attracted to the developing sleeve 260, or the like, the developers collide with each other, and the toner is separated from the carrier when the developers collide with each other.

Moreover, in the outflow portion 290, the inlet port 292 is placed at the position on a downstream side of line L3 connecting the rotation center O of the developing sleeve 260 and the separation position P1 in the rotation direction of the developing sleeve 260.

In the exemplary embodiment described above, the example in which the monochromatic image is formed by the image forming portion 100 is described. However, the present invention may also be applied to an apparatus in which multicolored images are formed by the image forming portion 100.

As described above, for example, the present invention may be applied to an image forming apparatus such as a printer, a facsimile machine, or a copier, and a developing device that is used in the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a storage container configured to store a developer;

a rotating body configured to supply the developer to an image holding member in a supply region by being rotated;

an inflow portion that is provided with an inflow port placed on a downstream side of the supply region in a rotation direction of the rotating body, and is configured to flow air into the storage container; and an outflow portion that is provided with an outflow port and is configured to emit air in the storage container from the outflow port, wherein the outflow port and the inflow port are adjacent to each other.

2. The developing device according to claim 1 further comprising:

a magnetic member including a plurality of magnetic poles, wherein the rotating body is configured to rotate around the magnetic member, wherein the plurality of magnetic poles include:

a separation magnetic pole configured to separate the developer from the rotating body; and an attraction magnetic pole configured to attract the developer to the rotating body, and wherein the developing device is configured to allow air in the storage container to flow into the outflow portion from a position on an upstream side of a line connecting a rotation center of the rotating body and the attraction magnetic pole in the rotation direction and on a downstream side of a line connecting the rotation center and the separation magnetic pole in the rotation direction.

3. The developing device according to claim 2, wherein the developing device is configured to allow the air in the storage container to flow into the outflow portion from a position on a downstream side of a line connecting the rotation center and a separation position at which the developer is separated from a surface of the rotating body in the rotation direction.

4. The developing device according to claim 1, wherein in a direction crossing a direction that air flows through the outflow portion, a cross-sectional area at the outflow port is larger than a cross-sectional area at an inlet port of the outflow portion, and wherein the developing device is configured to allow air in the storage container to flow into the outflow portion through the inlet port.

5. The developing device according to claim 2, wherein in a direction crossing a direction that air flows through the outflow portion, a cross-sectional area at the outflow port is larger than a cross-sectional area at an inlet port of the outflow portion, and wherein the developing device is configured to allow air in the storage container to flow into the outflow portion through the inlet port.

6. The developing device according to claim 3, wherein in a direction crossing a direction that air flows through the outflow portion, a cross-sectional area at the outflow port is larger than a cross-sectional area at an inlet port of the outflow portion, and wherein the developing device is configured to allow air in the storage container to flow into the outflow portion through the inlet port.

7. The developing device according to claim 1, further comprising:

a forming member that forms the inflow portion in a space between the rotating body and the forming member, and forms the outflow portion in a space between an inner wall of the storage container and the forming member.

8. The developing device according to claim 2, further comprising:

a forming member that forms the inflow portion in a space between the rotating body and the forming member, and forms the outflow portion in a space between an inner wall of the storage container and the forming member.

9. The developing device according to claim 3, further comprising:

a forming member that forms the inflow portion in a space between the rotating body and the forming member, and forms the outflow portion in a space between an inner wall of the storage container and the forming member.

10. The developing device according to claim 4, further comprising:

a forming member that forms the inflow portion in a space between the rotating body and the forming member, and forms the outflow portion in a space between an inner wall of the storage container and the forming member.

11. The developing device according to claim 5, further comprising:

a forming member that forms the inflow portion in a space between the rotating body and the forming member, and forms the outflow portion in a space between an inner wall of the storage container and the forming member.

12. The developing device according to claim 6, further comprising:

a forming member that forms the inflow portion in a space between the rotating body and the forming member, and forms the outflow portion in a space between an inner wall of the storage container and the forming member.

13. A developing device comprising:

a storage container configured to store a developer;

a rotating body that configured to supply the developer to an image holding member by being rotated;

a flow path that communicates a space inside the storage container with a space outside the storage container; and a divider disposed between an inner wall of the storage container and the rotating body so as to form the flow path between the inner wall and the divider, wherein the divider separates the flow path from the rotating body so that a first air flow between the rotating body and the divider and a second air flow between the divider and the inner wall flow in substantially opposite directions.

14. The developing device according to claim 13, wherein the flow path is configured such that a pressure at an outflow port from which air is emitted is lower than a pressure at an inlet port from which air flows in, and the pressure at the outflow port is equal to a pressure outside the flow path.

15. A developing device comprising:

a storage container configured to store a developer;

a rotating body configured to supply the developer to an image holding member; and a divider that divides a space between the rotating body and an inner wall of the storage container into an inflow portion and an outflow portion, wherein the inflow portion and the outflow portion communicate an inside of the storage container with an outside of the storage container, wherein the inflow portion is disposed adjacent to the rotating body and the outflow portion is adjacent to an inner wall of the storage container, and wherein a first distance between the divider and the inner wall of the storage container is different from a second distance between the divider and the rotating body at an outer end portion of the divider which is disposed at a side where the inflow portion and the outflow portion communicate with the outside of the storage container.

16. The developing device according to claim 15, wherein the first distance is longer than the second distance.

17. The developing device according to claim 15, wherein a third distance between the divider and the inner wall of the storage container is different from a fourth distance between divider and the rotating body at an inner end portion of the divider which is disposed at a side where the inflow portion and the outflow portion communicate with the inside of the storage container.

18. The developing device according to claim 17, wherein the third distance is shorter than the fourth distance.

19. A developing device comprising:

a storage container configured to store a developer;

a rotating body configured to supply the developer to an image holding member; and a divider that divides a space between the rotating body and an inner wall of the storage container into an inflow portion and an outflow portion, wherein the inflow portion and the outflow portion communicate an inside of the storage container with an outside of the storage container, wherein the inflow portion is disposed adjacent to the rotating body and the outflow portion is adjacent to an inner wall of the storage container, wherein a first distance between the divider and the inner wall of the storage container at an outer end portion of the divider is different from a second distance between the divider and the inner wall of the storage container at an inner end portion of the divider, wherein the outer end portion is disposed at a side where the inflow portion communicates with the outside of the storage container, and wherein the inner end portion is disposed at a side where the inflow portion communicates with the inside of the storage container.

20. The developing device according to claim 19, wherein the first distance is longer than the second distance.

* * * * *